United States Patent [19]

Sinclair

[11] 4,382,652

[45] May 10, 1983

[54] STACKABLE FLAT CONDUCTOR CABLE CONNECTOR ASSEMBLY

[75] Inventor: William Y. Sinclair, Stockton, N.J.

[73] Assignee: Aries Electronics, Inc., Frenchtown, N.J.

[21] Appl. No.: 226,164

[22] Filed: Jan. 19, 1981

[51] Int. Cl.[3] ..... H01R 13/58

[52] U.S. Cl. ..... 339/103 M

[58] Field of Search ..... 339/17 F, 101, 103 R, 339/103 M, 107, 176 MF, 206, 207, 208, 210

[56] References Cited

U.S. PATENT DOCUMENTS

| | | | |
|---|---|---|---|
| 3,487,160 | 12/1969 | Johnsen | 339/101 |
| 3,920,301 | 11/1975 | Roberts et al. | 339/17 F |
| 4,243,288 | 1/1981 | Lucius et al. | 339/206 R |
| 4,269,466 | 5/1981 | Huber | 339/176 MF |
| 4,278,314 | 7/1981 | Moser et al. | 339/176 MF |

*Primary Examiner*—Joseph H. McGlynn
*Assistant Examiner*—Paula Austin
*Attorney, Agent, or Firm*—Hedman, Casella, Gibson & Costigan

[57] ABSTRACT

A plurality of flat conductor cable connector assemblies according to the subject invention may be aligned in an abutting planar array such that the contacts of adjacent connector assemblies are spaced at 0.100 inch intervals corresponding to the 0.100 inch spacing between the individual contacts of each flat conductor cable connector assembly. Each of the latter includes a flat conductor cable having a plurality of uniformly spaced electrical conductors connected to the contacts which are disposed within the housing portion of a planar insulator block. The flat conductor cable is tapered adjacent said contacts, with the tapered width of the flat conductor cable corresponding to the tapered dimension of a tongue portion of the planar insulator block. An adhesive tape is wrapped around the tapered portion of the flat conductor cable and the tapered tongue portion of the planar insulator block for holding the flat conductor cable to the insulator block, while simultaneously providing strain relief for the assembly. The tapered portions of the flat conductor cable and the planar insulator block provide clearance for the thickness of the strain relief adhesive tape, whereby the overall width of the flat conductor cable connector assembly is equal to the width of the housing portion of the planar insulator block. Accordingly, when a plurality of the subject flat conductor cable connector assemblies are stacked in abutting relationship in an aligned planar array, the spacing between all of the contacts of the stacked arrangement is uniform, preferably on the order of 0.100 inches.

12 Claims, 5 Drawing Figures

STACKABLE FLAT CONDUCTOR CABLE CONNECTOR ASSEMBLY

The subject invention relates to a new and improved connector assembly for flat conductor cable, and more particularly a flat conductor cable connector assembly which is configured so as to insure that a plurality of such assemblies may be stacked in an abutting aligned, planar array, with the spacing between the individual contacts being uniform.

There are many applications in sophisticated electronic systems where a plurality of stacked flat conductor cable connectors are intended to be connected to a single connector, such as pin contacts extending from a printed circuit board or the like. In order to minimize the space required for the interconnection, it is desirable that the plurality of flat conductor cable connectors be mounted in abutting relationship in an aligned, planar array, with the contacts of each flat conductor cable connector, as well as the adjacent contacts between abutting connector assemblies being maintained on a uniform spacing, usually on the order of 0.100 inches. Heretofore, this has been difficult to achieve, primarily because of the construction of conventional flat conductor cable, as well as the construction of conventional connector housings employed in conjunction with flat conductor cables. More particularly, a flat conductor cable is formed by embedding a plurality of parallel conductors within a laminate formed of a plastic material, with the spacing between the individual conductors being uniform. However, usually additional insulating material is provided on the opposite edges of the flat conductor cable, with the width of the insulated material along the edges being greater than the width of insulation between conductors in the central portion of the cable. Furthermore, conventional connector housings are usually formed so as to include additional material at the opposed edges thereof. Hence, in the assembly of a flat conductor cable to a conventional connector housing, whereas the spacing between individual connectors may be uniform along the width of the assembly, the spacing between the end conductors to the side edge of the assembly is greater than one-half the spacing between individual conductors. As a result, when two conventional flat conductor cable connector assemblies are mounted in an abutting, aligned, parallel array, the spacing between adjacent conductors extending from abutting connector assemblies is greater than the spacing between the conductors within each connector assembly. As an example, the spacing of the conductors in an individual connector assembly may be 0.100 inches, whereas the spacing between adjacent conductors of abutting connector assemblies would be greater than 0.100 inches. Accordingly, said array of aligned, planar connector assemblies cannot readily be connected to a single connector assembly by virtue of the differential spacing between the conductors of the planar array.

Accordingly, it is an object of the subject invention to provide a new and improved flat conductor cable connector assembly which may be stacked in an aligned, planar array with a similar connector assembly, with the result that all the contacts of the stacked array are uniformly spaced.

It is a further object of the subject invention to provide a new and improved flat conductor cable connector assembly which includes strain relief, and which is simple in construction.

The above and further objects and advantages of the invention will become apparent from a reading of the following detailed description taken in conjunction with the drawings in which.

Figure 1:
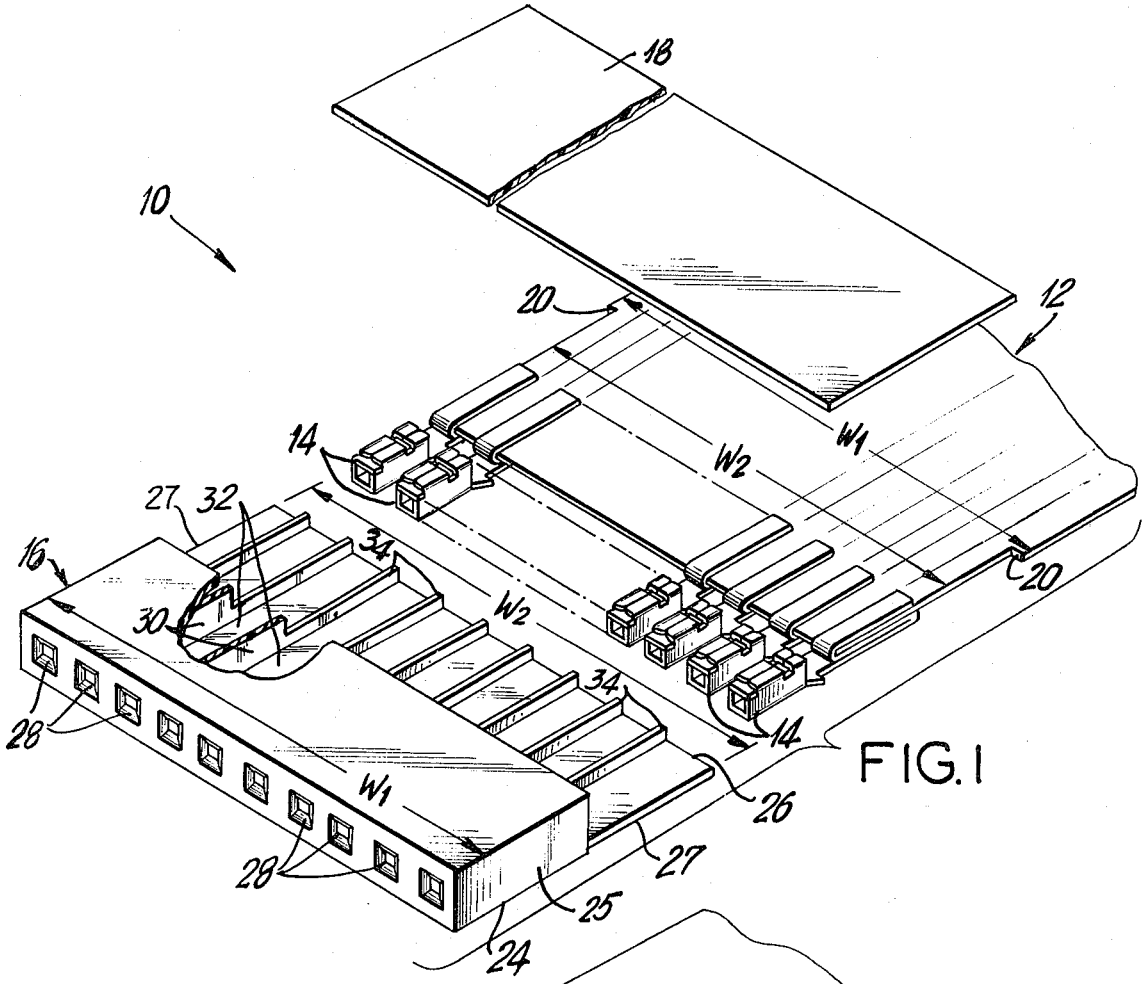
FIG. 1 is a perspective exploded view, partially in section, of a flat conductor cable connector assembly of the subject invention.

Turning to FIG. 1, the flat conductor cable connector assembly of the subject invention is generally designated by the numeral 10, and basically comprises a flat conductor cable 12 terminated at one end with a plurality of female contacts 14, an insulator block 16, and a strain relief holding means in the form of adhesive tape 18. The flat conductor cable 12 is formed from a conventional flat cable of the laminated or extrusion type, and includes either flat or round conductors which are laminated between two sheets of dielectric, plastic material. One end of the flat conductor cable 12 is terminated by a plurality of contacts 14, shown as female contacts, which are individually connected to the conductors of the flat conductor cable by crimping, soldering, or insulation piercing, in known manner. Alternatively, the contacts 14 may be male pins, depending on the particular application in which the invention is to be employed.

The flat conductor cable 12 is cut out at the opposite edges thereof, as indicated at 20, adjacent the contacts 14. Accordingly, the initial width $W_1$ of the flat conductor cable 12 is reduced in the region of the cut-outs 20 to a smaller width, designated $W_2$.

The insulator block 16 is preferably formed of a molded plastic material, and is of integral construction including a housing portion 24 and a tongue portion 26. The housing portion 24 includes in the end face thereof a plurality of spaced apertures 28 which respectively correspond to the number of and are aligned with the female contacts 14 of the flat conductor cable. Within the housing portion 24 there is formed a plurality of corresponding partitions 30 for defining compartments 32 for individually accommodating the female contacts 14. In like manner, the tongue portion 26 includes a corresponding plurality of upstanding partitions 34. The width of the housing portion 24 is designated $W_1$ and corresponds to the width $W_1$ of the flat conductor cable, whereas the width $W_2$ of the tongue portion 26 is less than the width of the housing portion 24, and corresponds to the reduced width portion $W_2$ of the flat conductor cable.

Preferably, the contacts 14, as well as the apertures 28 are spaced on 0.100 inch centers, with the end apertures and associated contacts being spaced from the side walls 25 of the housing portion 24 by a distance corresponding to 0.050 inches. Also, each cut-out 20 in the flat conductor cable, as well as the corresponding cut-outs 27 in the tongue portion 26 is on the order of 0.006 inches, as more fully described hereinafter.

The third major component of the flat conductor cable connector assembly 10 of the subject invention is the adhesive tape 18, which has a thickness on the order of 0.003 inches.

Figure 2:
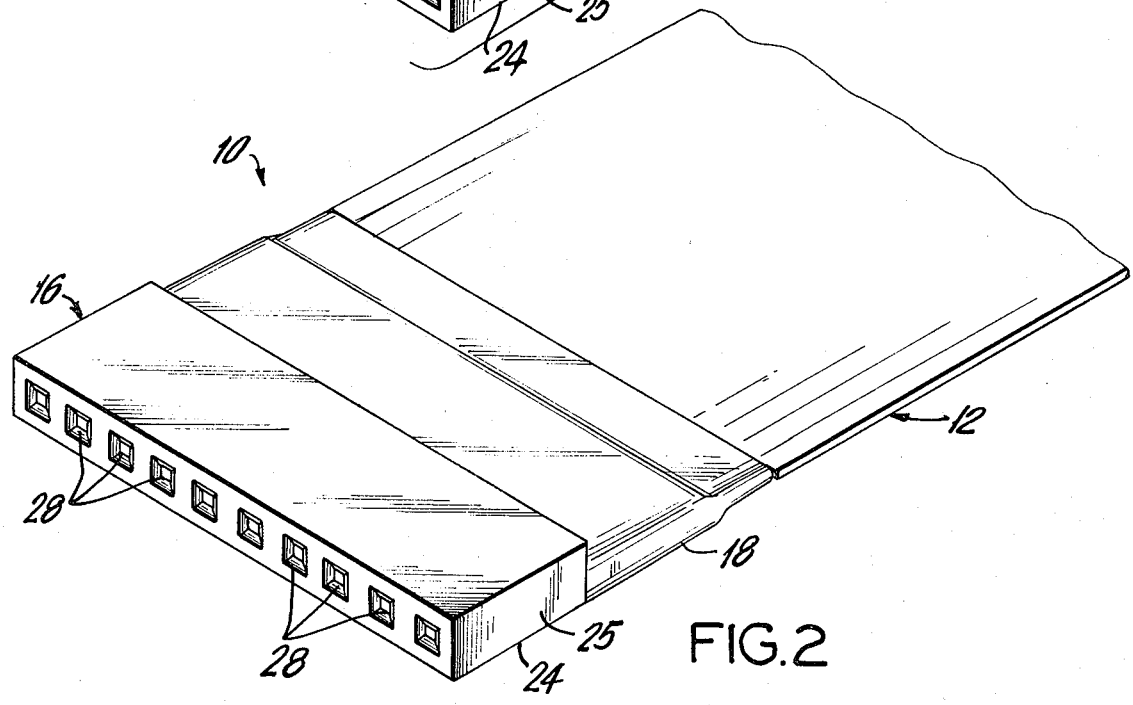
FIG. 2 is a perspective view of the flat conductor cable connector assembly of the subject invention.

Referring to FIG. 2, in the assembled condition of the flat conductor cable, connector assembly 10, the female contacts 14, which may be male pins in other applications, are respectively inserted into the compartments 32, with the cut-outs 20 being aligned with the opposed cut-out edges 27 of the tongue portion 26, after which the adhesive tape 18 is wrapped about the end of the flat conductor cable 12 so as to fixedly connect the flat conductor cable 12 to the insulator block 16. At such time, the insulative adhesive tape 18 effectively protects and insulates the opposed end conductors of the flat conductor cable 12, and fixedly connects the flat conductor cable to the insulator block in such manner as to simultaneously provide strain relief against axial pulling of the flat conductor cable relative to the insulator block 16. By virtue of the respective cut-out portions 20 in the flat conductor cable and the cut-out portions 27 of the tongue portion 26, the thickness of the adhesive tape 18 is accommodated within said cut-out portions so that the width of the interconnection of the adhesive tape 18 is not greater than the width $W_1$ of the assembly.

Figure 3:
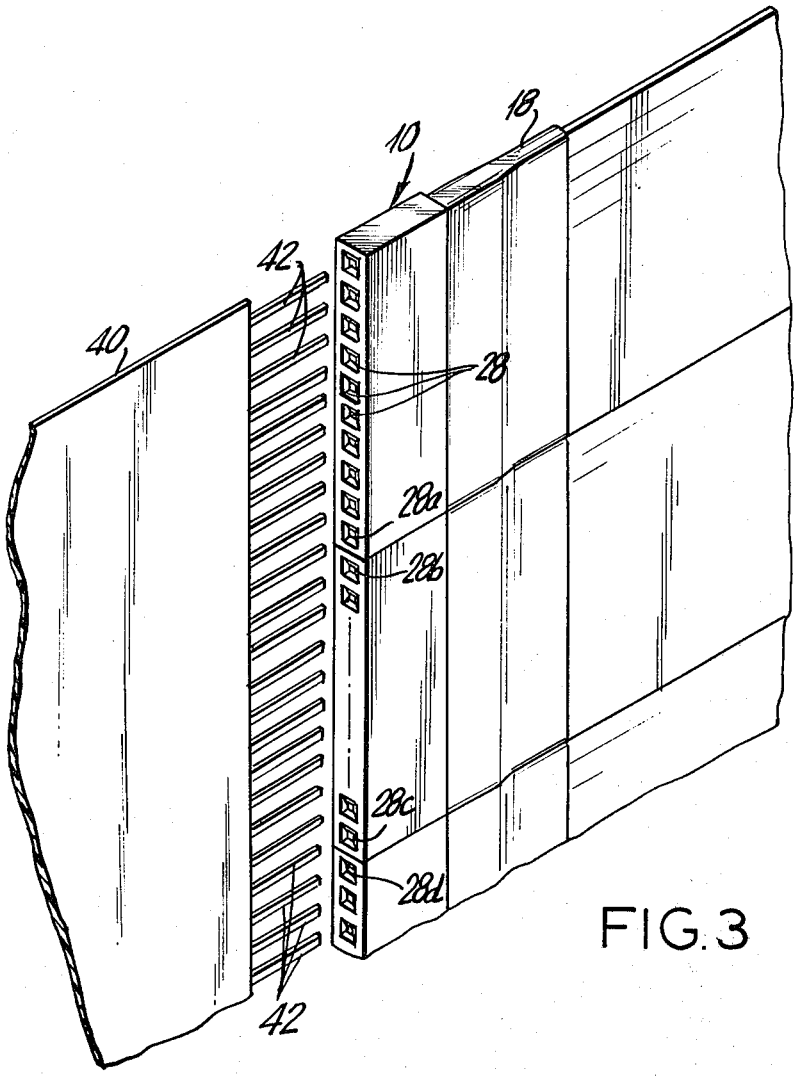
FIG. 3 is a perspective view of a plurality of flat conductor cable connector assemblies of the subject invention stacked in an aligned, planar array, preparatory to being connected to a printed circuit board assembly.
Figure 4:
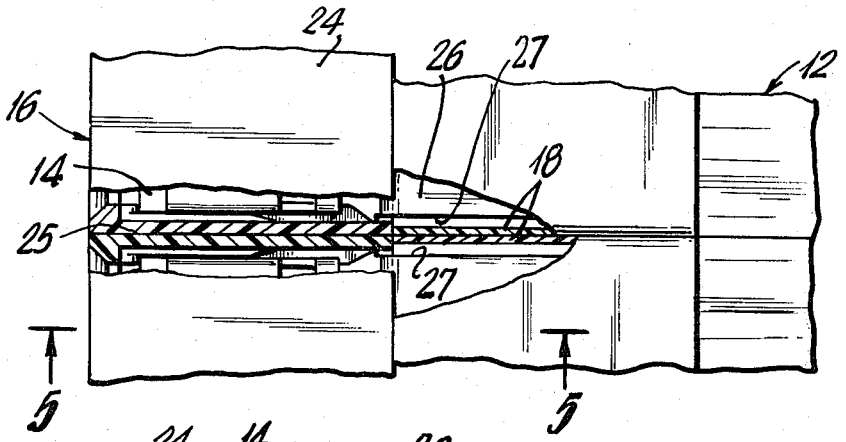
FIG. 4 is a top plan view, partially in section, of two abutting flat conductor cable connector assemblies according to the subect invention.
Figure 5:
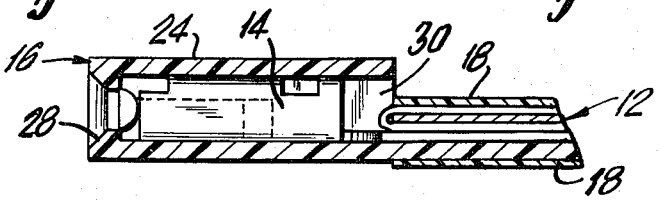
FIG. 5 is a cross-sectional view taken along line 5—5 in FIG. 4.

A plurality of flat conductor cable connector assemblies 10 may be employed in stacked arrangement, in a planar array whereby the center to center spacing between the apertures 28 (and hence the contacts 14) is maintained at a uniform spacing, even at the abutting junction of two stacked flat conductor cable connector assemblies 10. Referring to FIG. 3, a plurality of flat conductor cable connector assemblies 10 are disposed in stacked and abutting, planar array preparatory to a connection to an electrical component, such as a printed circuit board 40 having a plurality of uniformly spaced contacts 42 extending therefrom. As is readily apparent, in order to effect the interconnection of a plurality of stacked flat conductor cable assemblies 10 to a single printed circuit board 40, it is essential that the spacing between the apertures 28*a*, 28*b* and 28*c*, 28*d* of abutting connector assemblies 10 be spaced at a center to center distance corresponding to the center distance of the other apertures in the respective flat conductor cable connector assemblies 10. This is achieved in the subject invention by virtue of the new and improved construction thereof whereby the abutting flat conductor cable connector assemblies 12, as shown in FIG. 4, may be flush mounted since the width of the connector assembly is uniform along the length thereof, even in the region of the strain relief adhesive tape 18. As indicated in FIG. 5, the tape 18 preferably extends about the entire perimeter of the interconnection between the flat conductor cable 12 and the insulator block 16. This insures strain relief when an axial force is applied to either the flat conductor cable or the insulator block.

Accordingly, there is provided a new and improved connector assembly for a flat conductor cable. The subject connector assembly is capable of being stacked with similarly constructed conductor assemblies whereby the spacing between the contiguous contacts is maintained uniform with the spacing between the remaining contacts of the stacked assembly. To achieve this objective, the connector assembly of the subject invention employs a combination of a flat conductor cable which is terminated at one end with contacts, and with the width of the insulation material at the terminated end being reduced for accommodating the thickness of an adhesive tape which holds the flat conductor cable to an insulator block. The insulator block is constructed to include a housing portion which receives the terminated contacts of the flat conductor cable, as well as a tongue portion which is also reduced in width for accommodating the thickness of the adhesive tape which bonds the flat conductor cable to the insulator block. The resulting connector assembly accordingly has an envelope dimension equal to or less than the width of the initial flat conductor cable or insulator block, such that a plurality of such connector assemblies may be stacked in planar array for engagement with a single connector. Furthermore, the specific interconnection of the flat conductor cable to the insulator block provides a strain relief connection capable of absorbing axial forces and vibration.

It will be understood by those skilled in the art that the above-described embodiment is intended to be merely exemplary, in that it is capable of modification and variation without departing from the spirit and the scope of the invention. All such variations and modifications, therefore, are included within the scope of the invention as set forth in the appended claims.

What is claimed is:

1. A stackable flat conductor cable connector assembly comprising:

a flat conductor cable having a plurality of uniformly spaced electrical contacts extending from one end thereof, with the width of the flat conductor cable adjacent said contacts being tapered relative to the remainder of the flat conductor cable;

a generally planar insulator block having a housing portion and a tongue portion, said housing portion receiving said electrical contacts and including a corresponding plurality of apertures therein, said tongue portion being contiguous to said tapered portion of the flat conductor cable and being of a width corresponding to the width of the tapered portion of said flat conductor cable; and strain relief adhesive tape securing said flat conductor cable to said tongue portion of said insulator block in such manner that the total width of the flat conductor cable connector assembly is equal to or less than the width of said housing portion whereby a plurality of said flat conductor cable connector assemblies may be stacked in a generally aligned, planar array, with the spacing between the apertures of adjacent flat conductor cable connector assemblies substantially corresponding to the uniform spacing between apertures in the housing portion of each insulator block.

2. A stackable flat conductor cable connector assembly as in claim 1 wherein said housing portion of the insulator block includes a plurality of generally parallel internal partitions for defining a plurality of compartments for respectively housing the plurality of uniformly spaced electrical contacts of the flat conductor cable.

3. A stackable flat conductor cable connector assembly as in claim 1 wherein said tongue portion of the insulator block includes a plurality of upstanding partitions dividing said tongue portion into a plurality of compartments corresponding in number to the number of uniformly spaced electrical contacts of the flat conductor cable.

4. A stackable flat conductor cable connector assembly as in claim 1 wherein said flat conductor cable is of reduced width along each edge thereof on the order of 0.006 inches.

5. A stackable flat conductor cable connector assembly as in claim 1 wherein said adhesive tape is completely wrapped about the periphery of the contiguous tongue portion and tapered portion of the flat conductor cable.

6. A stackable flat conductor cable connector assembly comprising:

a flat conductor cable having a plurality of uniformly spaced electrical contacts extending from one end thereof, with the width of the flat conductor cable adjacent said contacts being tapered relative to the remainder of the flat conductor cable;

a generally planar insulator block having a housing portion and a tongue portion, said housing portion receiving said electrical contacts and including a corresponding plurality of apertures therein, said tongue portion including a plurality of upstanding partitions dividing said tongue portion into a plurality of compartments corresponding in number to the number of uniformly spaced electrical contacts of the flat conductor cable, said tongue portion being contiguous to said tapered portion of the flat conductor cable and being of a width corresponding to the width of the tapered portion of said flat conductor cable; and strain relief holding means securing said flat conductor cable to said tongue portion of said insulator block in such manner that the total width of the flat conductor cable connector assembly is equal to or less than the width of said housing portion whereby a plurality of said flat conductor cable connector assemblies may be stacked in a generally aligned, planar array, with the spacing between the apertures of adjacent flat conductor cable connector assemblies substantially corresponding to the uniform spacing between apertures in the housing portion of each insulator block.

7. A stackable flat conductor cable connector assembly as in claim 6 wherein said housing portion of the insulator block includes a plurality of generally parallel internal partitions defining a plurality of compartments for respectively housing the plurality of uniformly spaced electrical contacts of the flat conductor cable.

8. A stackable flat conductor cable connector assembly as in claim 6 wherein said strain relief holding means comprises an adhesive tape.

9. A stackable flat conductor cable connector assembly as in claim 8 wherein said adhesive tape is completely wrapped about the periphery of the contiguous tongue portion and tapered portion of the flat conductor cable.

10. A stackable flat conductor cable connector assembly comprising:

a flat conductor cable terminated at one end with a plurality of uniformly spaced electrical contacts, with the width of the flat conductor cable at the terminated end thereof being of reduced width relative to the remainder of the flat conductor cable;

a generally planar insulator block having a housing portion and a tongue portion, said housing portion including a plurality of internal partitions dividing said housing portion into a plurality of compartments respectively corresponding in number and spacing to said plurality of contacts of the flat conductor cable, said contacts being respectively received within said compartments, said housing portion including a corresponding plurality of apertures therein, with said tongue portion being contiguous to said reduced width portion of the flat conductor cable and being a width corresponding to the width of the terminated portion of said flat conductor assembly; and adhesive tape securing said terminated end of the flat conductor cable to said tongue portion of the insulator block in such manner that the total width of the flat conductor cable connector assembly is equal to or less than the width of said housing portion whereby a plurality of said flat conductor cable connector assemblies may be stacked in a generally aligned, planar array, with the spacing between the apertures of the adjacent flat conductor cable connector assemblies substantially corresponding to the uniform spacing between apertures in the housing portion of each insulator block.

11. A stackable flat conductor cable connector assembly as in claim 10 wherein said contacts are female connectors secured to the individual conductors of the flat conductor cable.

12. A stackable flat conductor cable connector assembly as in claim 10 wherein the width of the terminated end of the flat conductor cable is approximately 0.012 inches less than the width of the remainder of the flat conductor cable.

* * * * *